US011192116B2

(12) United States Patent
Schultz et al.

(10) Patent No.: US 11,192,116 B2
(45) Date of Patent: Dec. 7, 2021

(54) VERTICAL SHAFT IMPACT CRUSHER

(71) Applicant: Superior Industries, Inc., Morris, MN (US)

(72) Inventors: Michael Schultz, Troutdale, OR (US); Robert Ross, Ridgefield, WA (US)

(73) Assignee: Superior Industries, Inc., Morris, MN (US)

( * ) Notice: Subject to any disclaimer, the term of this patent is extended or adjusted under 35 U.S.C. 154(b) by 188 days.

(21) Appl. No.: 16/312,548

(22) PCT Filed: Jun. 29, 2017

(86) PCT No.: PCT/US2017/040061

§ 371 (c)(1),
(2) Date: Dec. 21, 2018

(87) PCT Pub. No.: WO2018/005836

PCT Pub. Date: Jan. 1, 2008

(65) Prior Publication Data

US 2019/0351425 A1 Nov. 21, 2019

Related U.S. Application Data

(60) Provisional application No. 62/406,799, filed on Oct. 11, 2016, provisional application No. 62/356,236, filed on Jun. 29, 2016.

(51) Int. Cl.
*B02C 13/18* (2006.01)

(52) U.S. Cl.
CPC ..... *B02C 13/1842* (2013.01); *B02C 13/185* (2013.01); *B02C 13/1807* (2013.01); *B02C 13/1814* (2013.01)

(58) Field of Classification Search
CPC ..... B02C 13/1842; B02C 13/185; B02C 13/1807; B02C 13/1814
See application file for complete search history.

(56) References Cited

U.S. PATENT DOCUMENTS

| | | | |
|---|---|---|---|
| 3,346,203 | A | 10/1967 | Danyluke |
| 3,955,767 | A | 5/1976 | Hise |
| 4,145,009 | A | 3/1979 | Fukui |
| D254,256 | S | 2/1980 | Ackers et al. |

(Continued)

FOREIGN PATENT DOCUMENTS

| | | | |
|---|---|---|---|
| AU | 2016206754 | A1 | 12/2016 |
| CN | 204486000 | U | 7/2015 |

(Continued)

OTHER PUBLICATIONS

Cemco, "Turbo Vertical Shaft Impact Crushers" Brochure, Belen, New Mexico; 2013, 20 pages.

(Continued)

*Primary Examiner* — Adam J Eiseman
*Assistant Examiner* — Mohammed S. Alawadi
(74) *Attorney, Agent, or Firm* — Todd R. Fronek; Larkin Hoffman Daly & Lindgren, Ltd

(57) ABSTRACT

Vertical shaft crushers and control systems therefor are disclosed. In some embodiments a rotor of the crusher is reversible and/or autogenous. In some embodiments a crushing chamber of the crusher includes at least one anvil and at least one rock shelf chamber.

30 Claims, 14 Drawing Sheets

(56) References Cited

U.S. PATENT DOCUMENTS

| | | | | |
|---|---|---|---|---|
| 4,347,998 | A | 9/1982 | Loree | |
| 4,373,678 | A | 2/1983 | Reitter | |
| 4,389,022 | A | 6/1983 | Burk | |
| 4,390,136 | A * | 6/1983 | Burk | B02C 13/1842 241/275 |
| 4,397,426 | A * | 8/1983 | Warren | B02C 13/1814 241/275 |
| 4,560,113 | A | 12/1985 | Szalanski | |
| 4,575,013 | A | 3/1986 | Bartley | |
| 4,575,014 | A * | 3/1986 | Szalanski | B02C 13/1842 340/853.5 |
| 4,586,663 | A | 5/1986 | Bartley | |
| 4,659,026 | A * | 4/1987 | Krause | B02C 13/1842 241/275 |
| 4,699,326 | A * | 10/1987 | Warren | B02C 13/1814 241/275 |
| 4,756,484 | A | 7/1988 | Bechler et al. | |
| 4,896,838 | A * | 1/1990 | Vendelin | B02C 13/1842 241/275 |
| 4,915,309 | A | 4/1990 | Schmidt | |
| 4,940,188 | A * | 7/1990 | Rodriguez | B02C 13/1842 241/275 |
| 5,029,761 | A | 7/1991 | Bechler | |
| 5,323,974 | A * | 6/1994 | Watajima | B02C 13/1814 241/275 |
| 5,323,978 | A | 6/1994 | Watajima | |
| 5,806,774 | A | 9/1998 | Vis | |
| 5,829,698 | A | 11/1998 | Canada | |
| 5,911,370 | A | 6/1999 | Lusty | |
| 5,954,282 | A | 9/1999 | Britzke et al. | |
| 5,976,043 | A | 11/1999 | Hise | |
| 6,003,796 | A | 12/1999 | James | |
| 6,070,820 | A * | 6/2000 | Young | B02C 13/1814 241/275 |
| 6,382,536 | B1 | 5/2002 | Lusty et al. | |
| 6,405,953 | B1 | 6/2002 | Warren | |
| 6,416,000 | B1 | 7/2002 | Lusty et al. | |
| 6,554,215 | B1 * | 4/2003 | Schultz | B02C 13/1835 241/275 |
| 6,588,692 | B1 | 7/2003 | Poncin | |
| D491,586 | S | 6/2004 | Dallimore et al. | |
| 6,802,466 | B1 | 10/2004 | Van Der Zanden | |
| 7,090,159 | B2 * | 8/2006 | Condon | B02C 13/1814 241/275 |
| 7,257,876 | B2 | 8/2007 | Dallimore | |
| 7,300,009 | B2 * | 11/2007 | Dallimore | B02C 13/1842 241/275 |
| 7,322,536 | B2 | 1/2008 | Garvin et al. | |
| 7,350,725 | B2 | 4/2008 | Dallimore et al. | |
| 7,530,512 | B2 | 5/2009 | Dallimore et al. | |
| 7,677,484 | B2 | 3/2010 | Dallimore et al. | |
| 7,726,597 | B2 | 6/2010 | Bentley | |
| 7,823,821 | B2 | 11/2010 | Strauss et al. | |
| 7,841,551 | B2 | 11/2010 | Potter et al. | |
| 7,854,407 | B2 | 12/2010 | Potter et al. | |
| D636,118 | S | 4/2011 | Kim et al. | |
| 7,942,357 | B2 | 5/2011 | Dallimore et al. | |
| 8,020,791 | B2 * | 9/2011 | Knueven | B02C 13/1807 241/5 |
| 8,025,247 | B2 | 9/2011 | Dallimore et al. | |
| 8,042,756 | B2 | 10/2011 | Dallimore et al. | |
| 8,104,704 | B2 | 7/2012 | Strauss et al. | |
| 8,393,820 | B2 | 3/2013 | Rodriguez | |
| 8,418,945 | B2 | 4/2013 | Kjaerran et al. | |
| 8,561,926 | B2 | 10/2013 | Dallimore et al. | |
| 8,651,407 | B2 | 2/2014 | Berton | |
| D724,633 | S | 3/2015 | Foster | |
| 8,967,516 | B2 | 3/2015 | Dallimore et al. | |
| D738,178 | S | 9/2015 | Eisinger | |
| D745,572 | S | 12/2015 | Bergman et al. | |
| D766,334 | S | 9/2016 | Bergman et al. | |
| D768,844 | S | 10/2016 | Koseoglu et al. | |
| D781,935 | S | 3/2017 | Larsson et al. | |
| D795,606 | S | 8/2017 | Cudworth | |
| D800,187 | S | 10/2017 | Larsson et al. | |
| D804,436 | S | 12/2017 | Tauchi et al. | |
| D815,160 | S | 4/2018 | Neubauer | |
| D816,126 | S | 4/2018 | Bergman et al. | |
| D847,224 | S * | 4/2019 | Schultz | B02C 13/185 D15/123 |
| 2004/0011905 | A1 | 1/2004 | Van Der Zanden | |
| 2007/0108327 | A1 * | 5/2007 | Rodriguez | B02C 13/2804 241/275 |
| 2008/0121746 | A1 | 5/2008 | Hall et al. | |
| 2008/0265075 | A1 | 10/2008 | Dallimore et al. | |
| 2010/0025512 | A1 | 2/2010 | Liimatainen et al. | |
| 2010/0090045 | A1 | 4/2010 | Dallimore et al. | |
| 2014/0252144 | A1 | 9/2014 | Dallimore et al. | |
| 2015/0048191 | A1 * | 2/2015 | Clint | B02C 13/2804 241/275 |
| 2015/0053805 | A1 | 2/2015 | Hackworth | |
| 2017/0106374 | A1 | 4/2017 | Ha | |
| 2017/0209866 | A1 | 7/2017 | Forsberg et al. | |

FOREIGN PATENT DOCUMENTS

| | | | |
|---|---|---|---|
| CN | 205182849 | U | 4/2016 |
| CN | 205613488 | U | 10/2016 |
| CN | 104722376 | B | 5/2017 |
| CN | 106622490 | A | 5/2017 |
| EP | 3156129 | A4 | 2/2018 |
| WO | 2011128854 | A2 | 10/2011 |

OTHER PUBLICATIONS

ISC, "Vertical Shaft Impact (VSI) Crushers" Presentation Material, Spokane, Washington; 2010, 76 pages.

Metso, "Barmac B-series VSI, Wear Parts Application Guide" Brochure; 2012, 16 pages.

Remco, "Crushers—3rd Edition" Brochure, Livermore, California; 2006, 22 pages.

Sandvik, "VSI Rotors CV200 Series" Brochure; 2011, 4 pages.

Spokane Industries, "Ultra Wear-Resistant Solutions" Brochure; 2011, 2 pages.

Stedman, "Slam Vertical Shaft Impactors" Brochure, Aurora, Indiana; 2011, 3 pages.

Terex, "Vertical Shaft Impact Crushers" Brochure; 2011, 8 pages.

International Search Report and Written Opinion, PCT Application No. PCT/US2017/040061, dated Oct. 31, 2017, 13 pages.

* cited by examiner

VERTICAL SHAFT IMPACT CRUSHER

CROSS REFERENCE TO RELATED APPLICATIONS

This application claims priority to U.S. Prov. App. Ser. No. 62/356,236, filed on Jun. 29, 2016 and U.S. Prov. App. Ser. No. 62/406,799, filed on Nov. 10, 2016, the contents of which are both hereby incorporated by reference in their entirety.

BACKGROUND

Crushers are used to reduce the size of aggregate material such as rock. Impact crushers generally operate by throwing aggregate material. Vertical shaft impact crushers generally throw aggregate material for crushing by rotating the material about a generally vertical axis.

DESCRIPTION

Vertical impact crusher embodiments are disclosed herein having, inter alia, various rotor embodiments and/or various crushing chamber embodiments.

Figure 1:
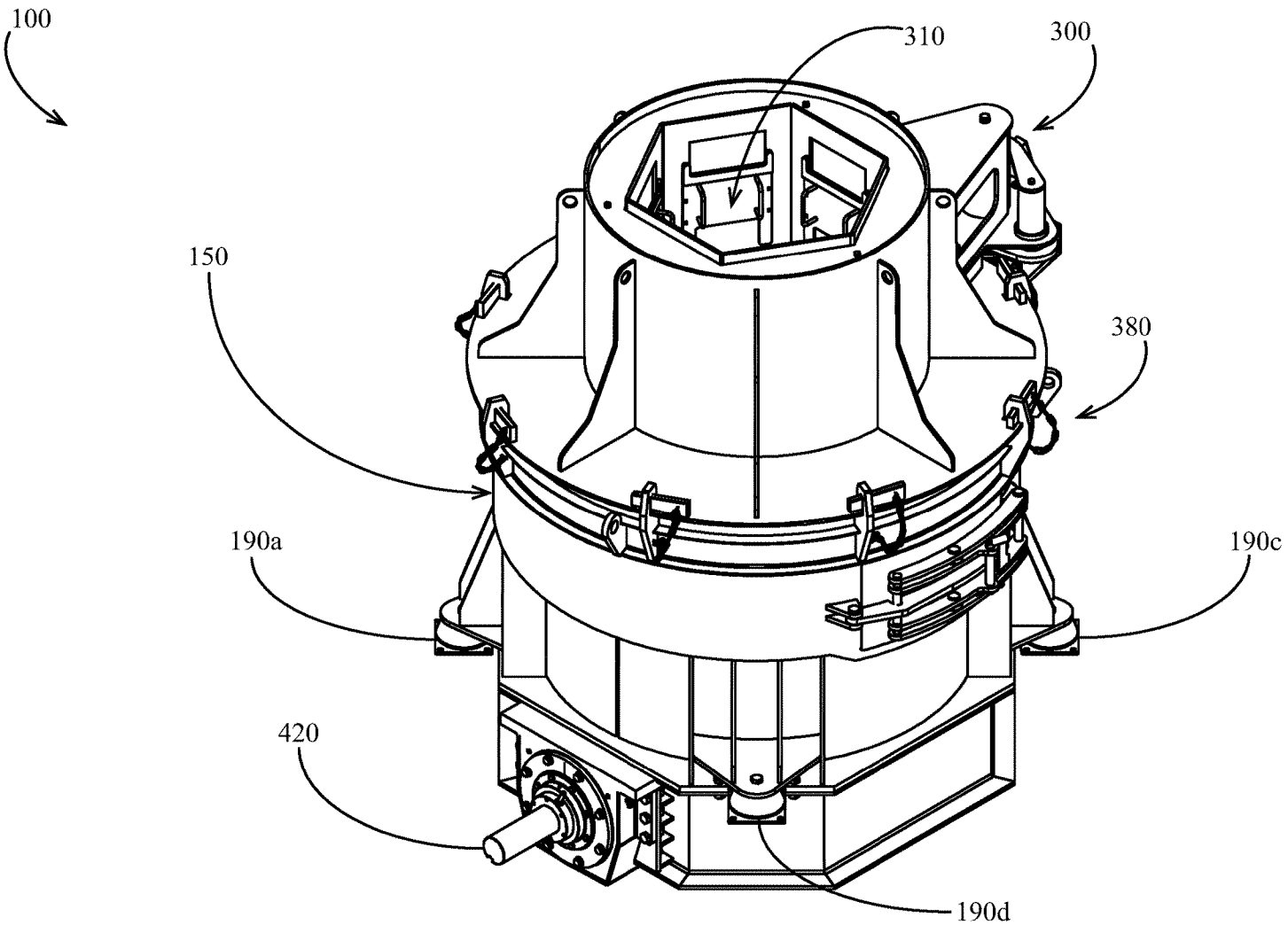
FIG. 1 is an isometric view of an embodiment of a vertical shaft impact crusher.
Figure 2:
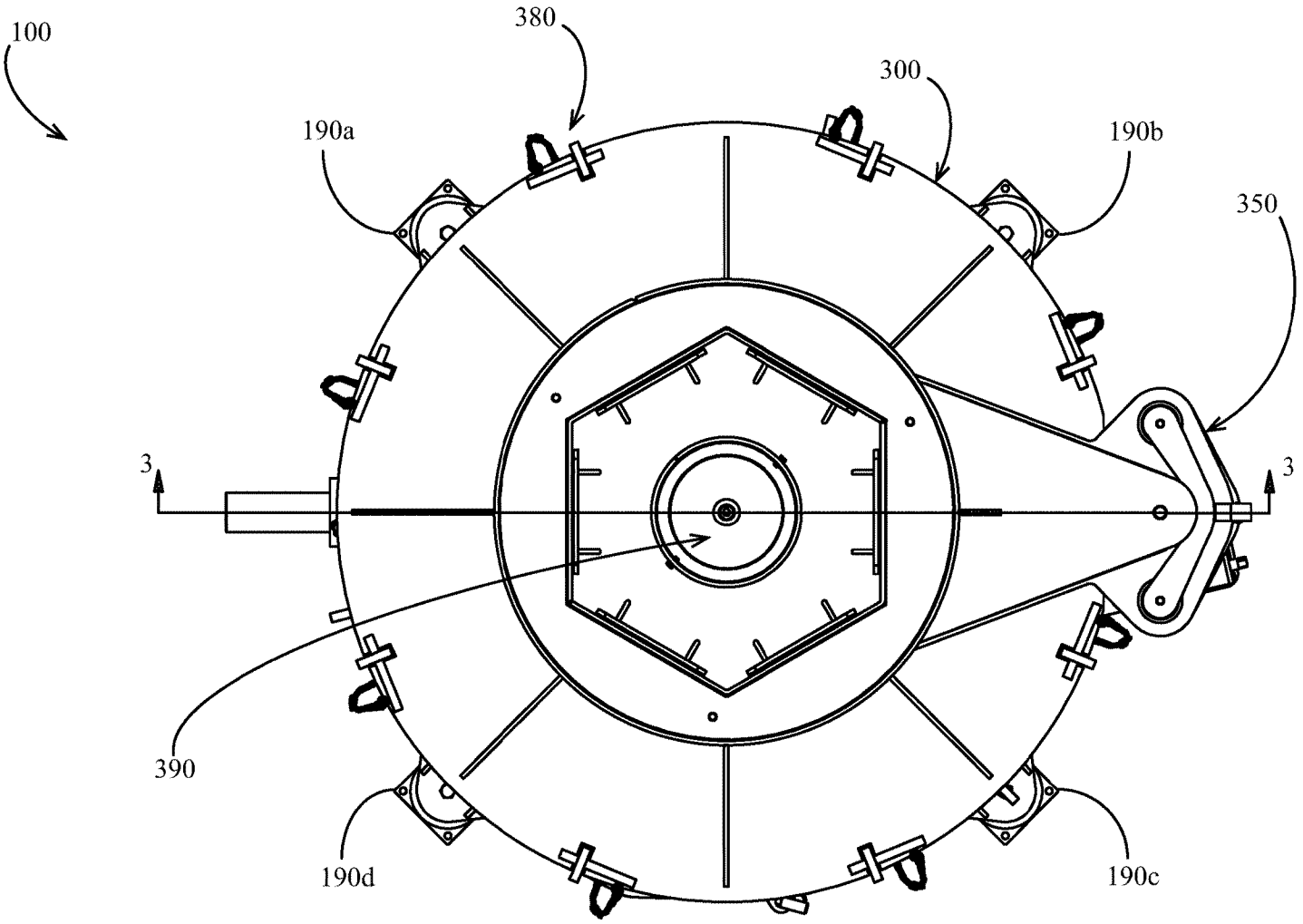
FIG. 2 is a top plan view of the crusher of FIG. 1.
Figure 3:
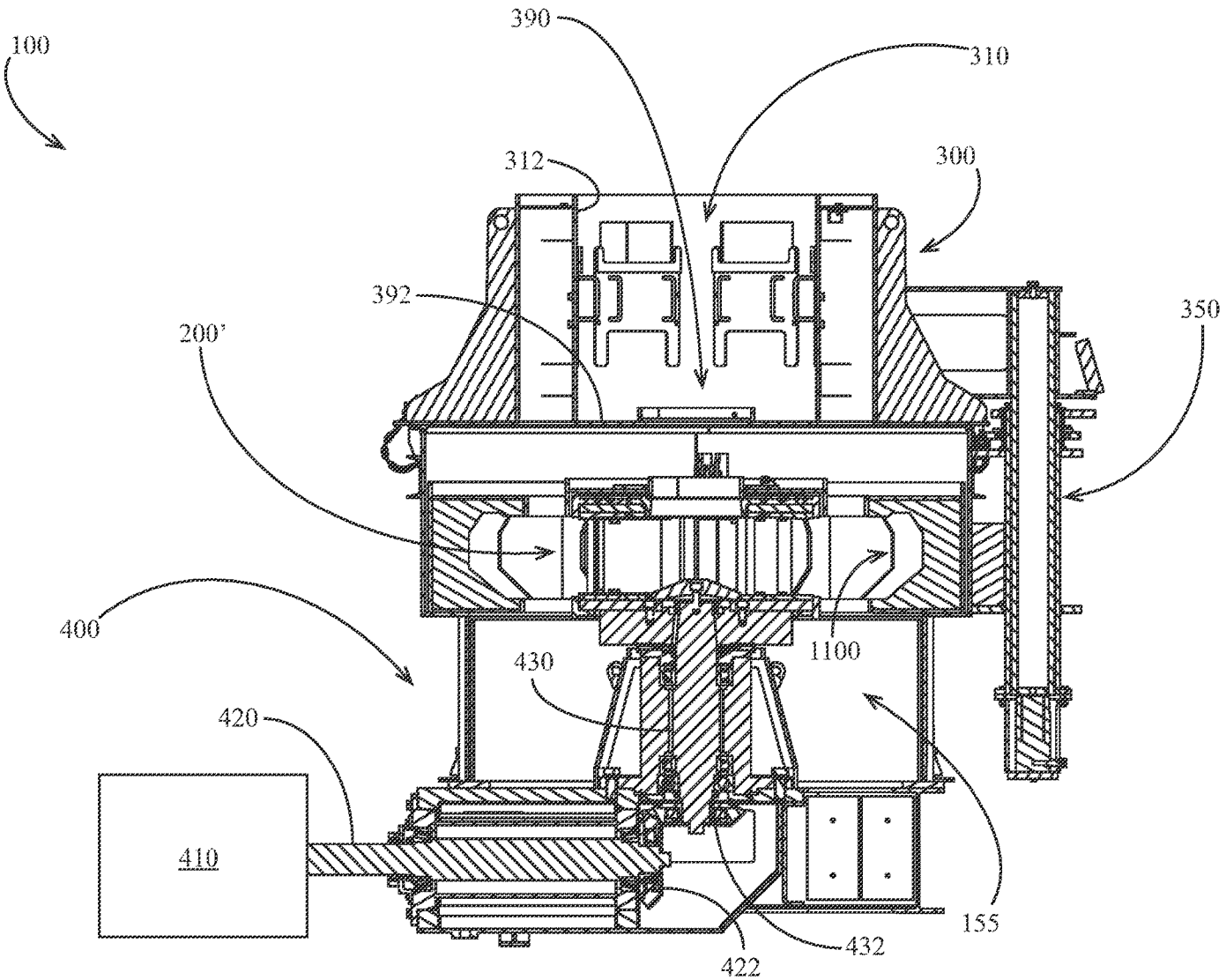
FIG. 3 is a sectional side elevation view of the crusher of FIG. 1 along the section 3-3 of FIG. 2.
Figure 4:
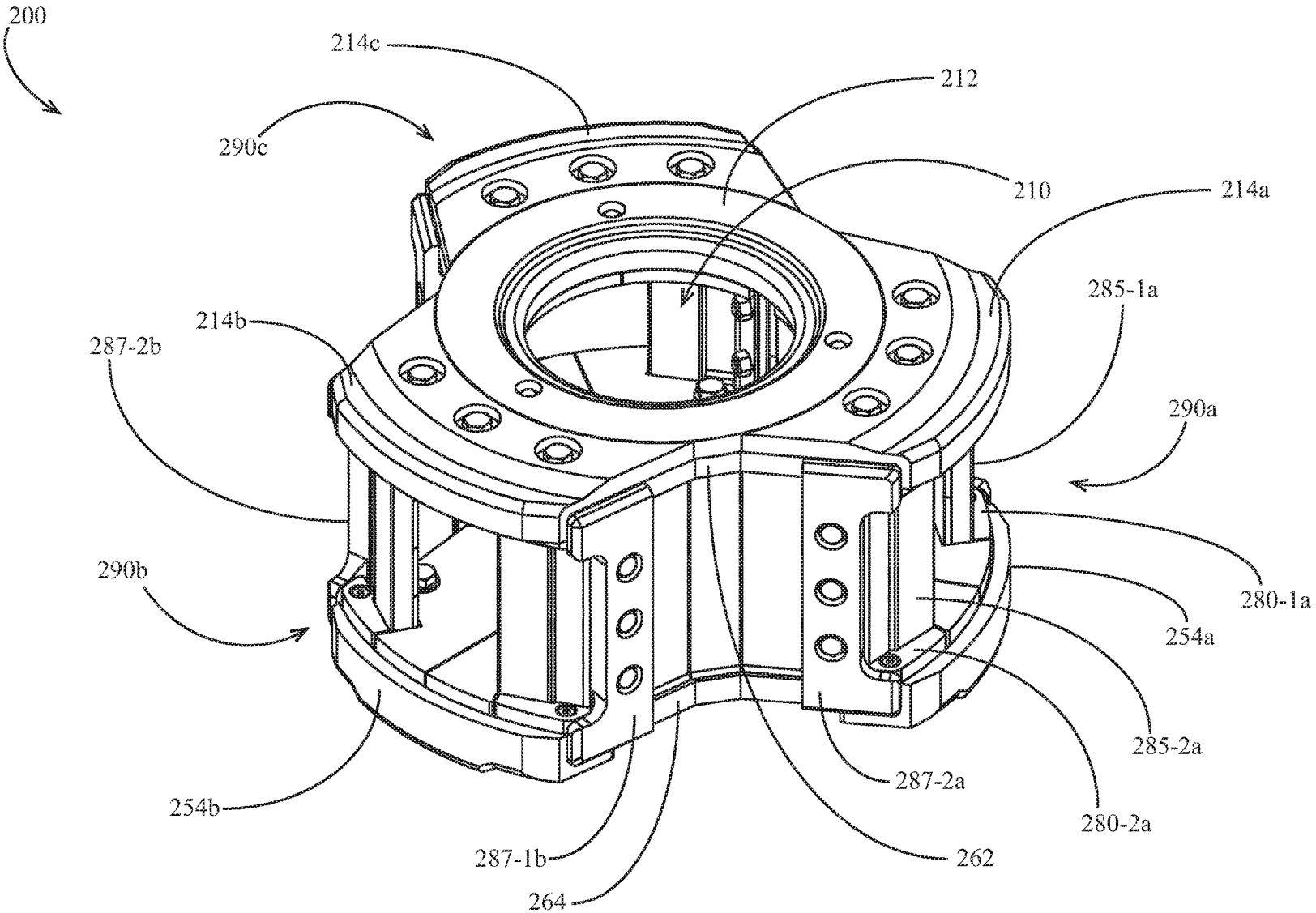
FIG. 4 is an isometric view of an embodiment of an impact crusher rotor.

Referring to the drawings, wherein like reference numerals designate identical or corresponding parts throughout the several views, FIGS. 1-3 illustrate a vertical shaft impact crusher 100. Some crusher embodiments disclosed herein may generally have one or more features or functionality (e.g., inlet, rotor, crushing chamber, drive element) in common with vertical shaft impact crushers such as that disclosed in U.S. Pat. Nos. 4,560,113; 4,896,838; and 7,726,597, all of which are hereby incorporated by reference herein in their entirety. The crusher 100 optionally includes a cover 300 having an inlet 310 for receiving aggregate material (e.g., stone, rock such as raw or previously crushed or processed rock, etc.). The cover 300 optionally includes one or more assemblies 380 (e.g., removable wedge assemblies as illustrated) for selectively locking the cover 300 to a housing 150 of the crusher 100. The crusher 100 optionally includes an actuator assembly 350 for selectively lifting and/or turning the cover 300 away from the housing 150. The crusher 100 is optionally secured to a frame, floor or other support structure by a plurality of footings 190 mounted to the housing 150.

Figure 5:
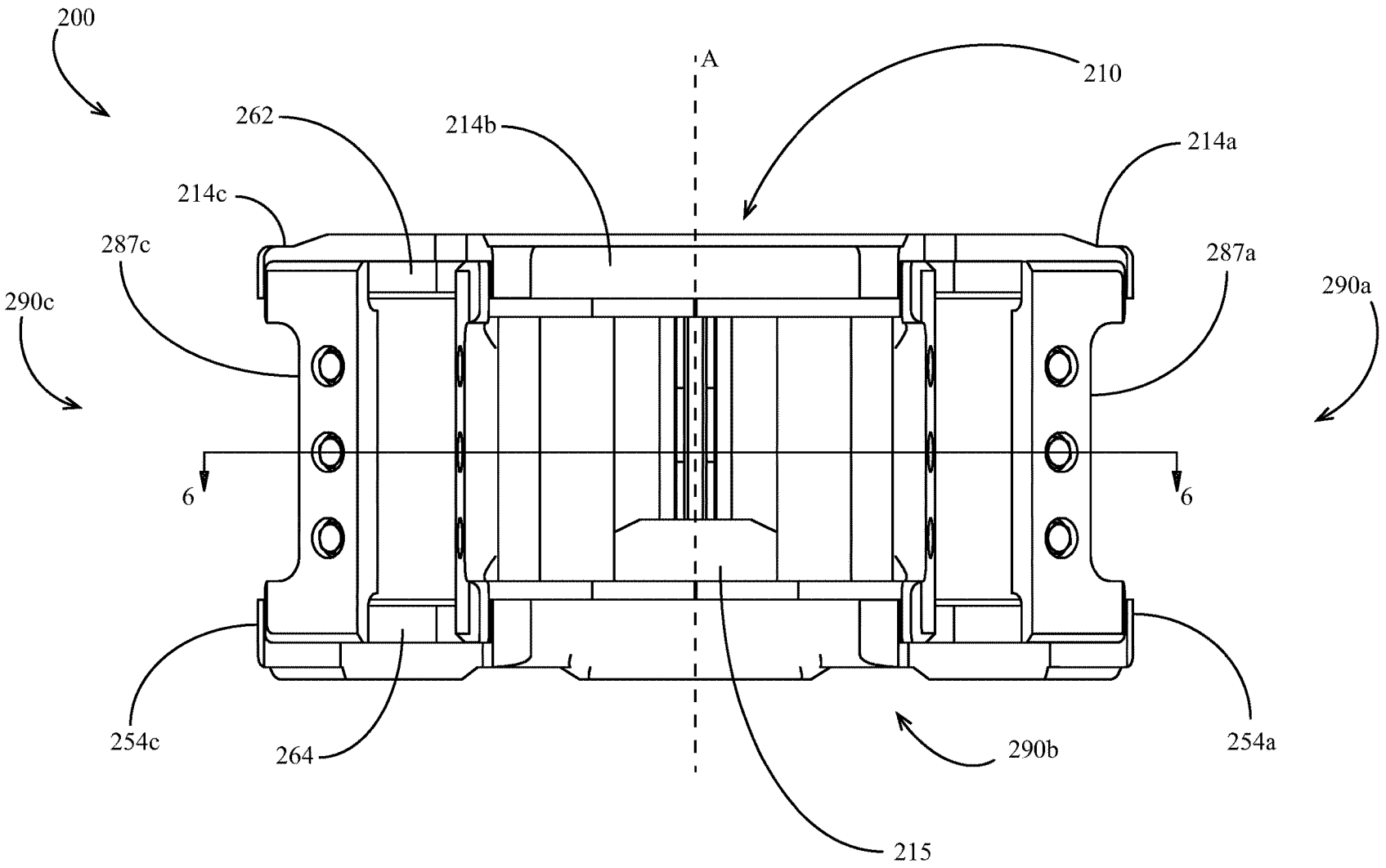
FIG. 5 is a side elevation view of the rotor of FIG. 4.
Figure 6:
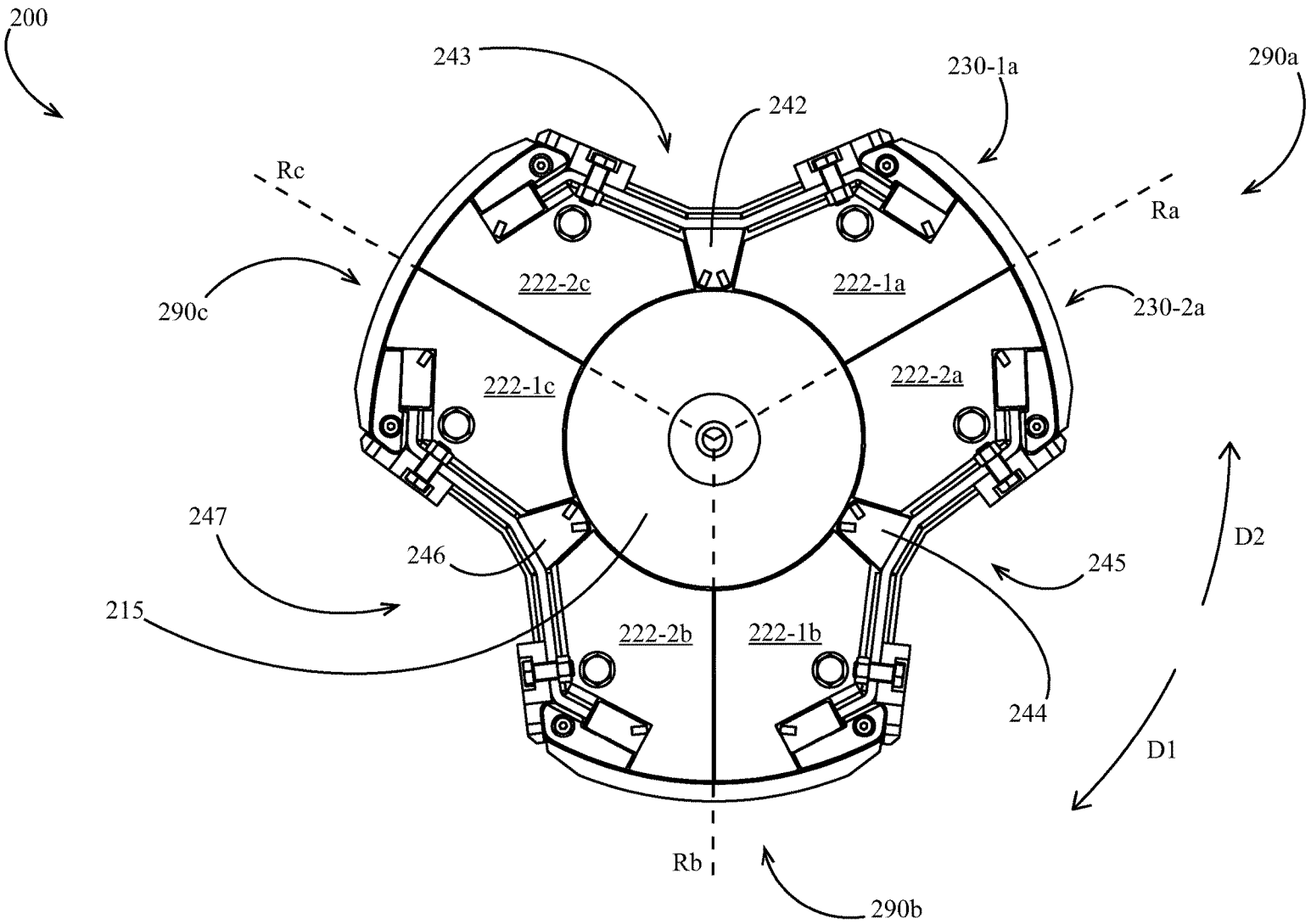
FIG. 6 is a sectional side elevation view of the rotor of FIG. 4 along the section 6-6 of FIG. 5.

The cover 300 optionally includes one or more sidewalls 312 generally arranged about the inlet 310. The inlet 310 optionally includes a floor 392 having an opening 390. A rotor 200' is optionally disposed beneath the opening 390. The rotor 200' is optionally driven for rotation about a vertical axis A (see FIG. 5) by a drive system 400. The drive system 400 optionally includes a motor 410 (e.g., an electric or other motor or other power source) which optionally drives one or more driving elements such as an output shaft 420. The output shaft 420 is optionally mechanically coupled to a rotor shaft 430 in order to drive the rotor shaft 430 about a vertical axis. An output gear 422 is optionally mounted to the output shaft 420 and optionally drives a rotor shaft gear 432, which is optionally mounted to the rotor shaft 430. In some embodiments, the output gear 422 and rotor shaft gear 432 may comprise bevel gears disposed at a relative offset angle (e.g., 90 degrees). The rotor shaft 430 is optionally fixed (e.g., at an upper end thereof) to the rotor 200' (e.g., a lower surface thereof) in order to drive the rotor 200' for rotation about a vertical axis (e.g., a central vertical axis of the rotor). In other embodiments, other driving elements may be used to operably couple a motor to the rotor for rotation of the rotor.

In operation, aggregate material optionally enters the inlet 310 (e.g., after being deposited by a conveyor or other device separate from the crusher 100) and falls through the opening 390 into the rotor 200'. Rotation of the rotor 200' optionally tends to propel the aggregate material (e.g., centrifugally) generally radially outwardly from the rotor 200. A crushing chamber 1100 is optionally disposed about the rotor 200' (e.g., generally concentrically about the axis of rotation of the rotor). In operation, aggregate material propelled from the rotor 200' optionally contacts the crushing chamber (and/or other aggregate material in the crushing chamber), resulting in comminution (e.g., crushing, breaking) of at least some of the aggregate material. Comminuted aggregate material optionally falls into a generally annular discharge volume 155 of the housing. Comminuted aggregate material optionally exits the discharge volume 155 by gravity via an opening and/or chute disposed generally below the discharge volume.

Referring to FIGS. 4-9, an embodiment of a rotor 200 is illustrated. The rotor 200 is not necessarily identical to the rotor 200' illustrated in FIG. 3.

The rotor 200 optionally generally comprises a lower plate 264 and an upper plate 262. The upper and lower plates are optionally retained in vertically spaced-apart relation by one or more sidewalls, e.g., radially arranged sidewalls 243, 245, 247. In one embodiment, the upper and lower plates and the sidewalls may be made of metal such as steel (e.g., a mild steel such as A36 steel).

The rotor 200 optionally includes an upper opening 210 into which aggregate material is optionally received in operation. The upper opening 210 is optionally bounded by an inlet ring 212 which may be removably mounted (e.g., by bolts or other fasteners) to the upper plate 262. Aggregate material received through opening 210 optionally falls onto a distributor plate 215 optionally disposed generally at the bottom of the rotor 200. Other embodiments omit the distributor plate. The distributor plate 215 is optionally downwardly angled from the rotational axis of the rotor to an outer edge (e.g., circumference) of the distributor plate; for example, the distributor plate may be generally conical in shape. In other embodiments the distributor plate 215 may be generally flat. One or more wear plates 222 (e.g., flat plates which may be made of a suitable material such as cast steel) are optionally disposed generally at the bottom of the rotor 200 between the distributor plate 215 and each opening 290. The wear plate or wear plates 222 optionally form a floor of the rotor radially inward of the opening 290. The wear plates 222 are optionally removably mounted to a bottom plate 264 of the rotor 200, e.g., by bolts 223. In some embodiments, two wear plates 222-1, 222-2 are disposed generally symmetrically about each radial plane R. In some embodiments, a single wear plate is disposed generally symmetrically about each radial plane R. In operation, at least some aggregate material falling onto the distributor plate 215 optionally moves radially outwardly under the influence of gravity and/or centrifugal force to a position on or above the wear plates 222 associated with each radial plane R.

In operation, rotation of the rotor 200 (e.g., about a central vertical axis thereof) optionally propels aggregate material (e.g., centrifugally) from one or more openings 290 (e.g., three openings 290*a*, 290*b*, 290*c*). The openings 290 are optionally radially arranged about the rotational axis of the rotor 200. The openings 290*a*, 290*b*, 290*c* are optionally disposed along radial planes Ra, Rb, Rc, respectively. Each opening 290 is optionally disposed symmetrically about a radial plane R intersecting the opening.

Figure 7:
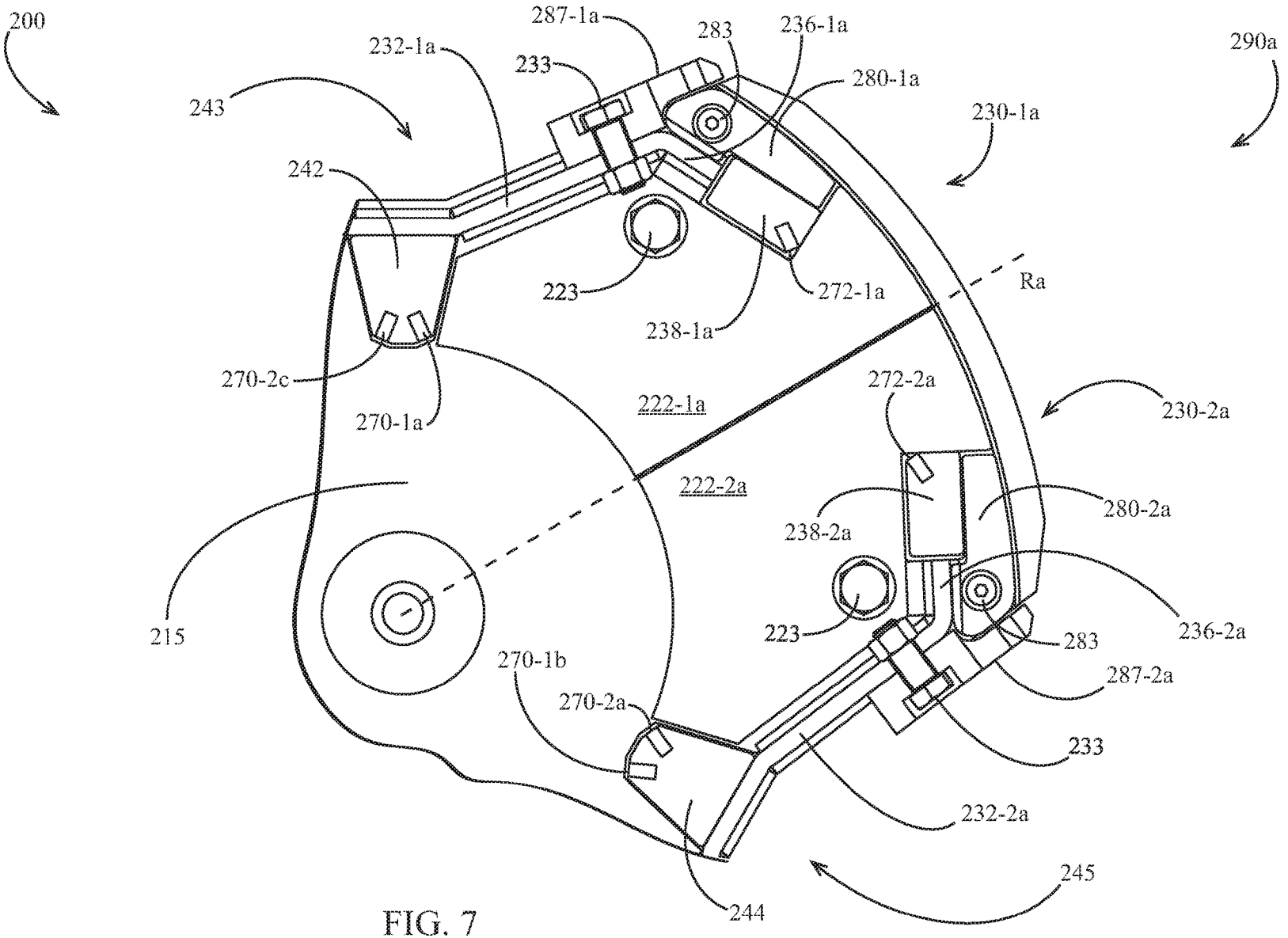
FIG. 7 a partial sectional side elevation view of the rotor of FIG. 4 along the section 6-6 of FIG. 5.

Referring to FIG. 7, wall arrangements 230-1, 230-2 are optionally disposed laterally on either side of each opening 290. In some embodiments, the wall arrangements 230-1, 230-2 are generally disposed in symmetrical relation to one another about the radial plane R passing through the associated opening 290. Each wall arrangement 230 optionally comprises a rear wear tip holder (e.g., one of three rear wear tip holders 242, 244, 246 which are optionally disposed radially inwardly of the sidewalls 243, 245, 247, respectively). The rear wear tip holder optionally holds a wear tip 270. The wear tip 270 optionally extends substantially along a height between the lower plate 264 and the upper plate 262. The wear tip 270 optionally comprises a wear-resistant material such as tungsten carbide. A first wall portion 232 optionally extends generally outwardly from the wear tip holder toward the opening 290. A second wall portion 236 optionally extends from a generally outer end of the first wall portion 232 toward the opening 290. The first and second wall portions optionally form a single sidewall and may comprise a single component (e.g., a bent plate) or in some embodiments may comprise two or more components (e.g., two or more plates joined such as by welding).

The first wall portion 232 is optionally disposed at a first offset angle relative to the radial plane R extending through the opening 290. The second wall portion 236 is optionally disposed at a second offset angle relative to the radial plane R extending through the opening 290. The second offset angle is optionally greater in magnitude than the first offset angle. A forward wear tip holder 238 optionally extends generally from the second wall portion 236 toward the opening 290. The forward wear tip holder 238 optionally supports a wear tip 272. The wear tip 272 is optionally disposed adjacent to the opening 290. The wear tip 272 optionally extends substantially along a height between the lower plate 264 and the upper plate 262. The wear tip 272 optionally comprises a wear-resistant material such as tungsten carbide. Wear tips 272-1, 272-2 associated with wall arrangements 230-1, 230-2, respectively are optionally disposed at opposing lateral sides of the opening 290.

Figure 15:
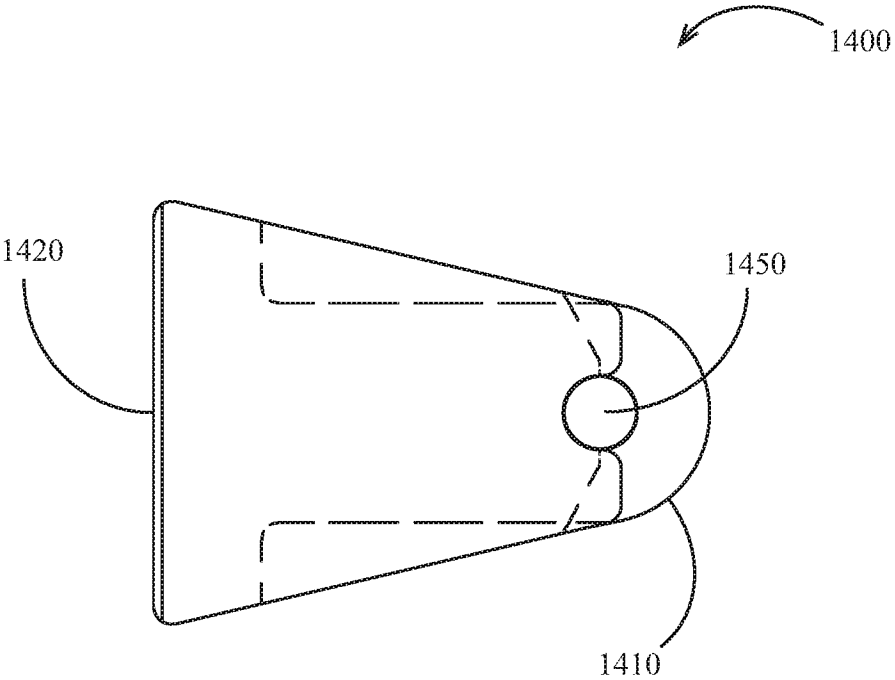
FIG. 15 is a plan view of the wear tip holder of FIG. 14.
Figure 14:
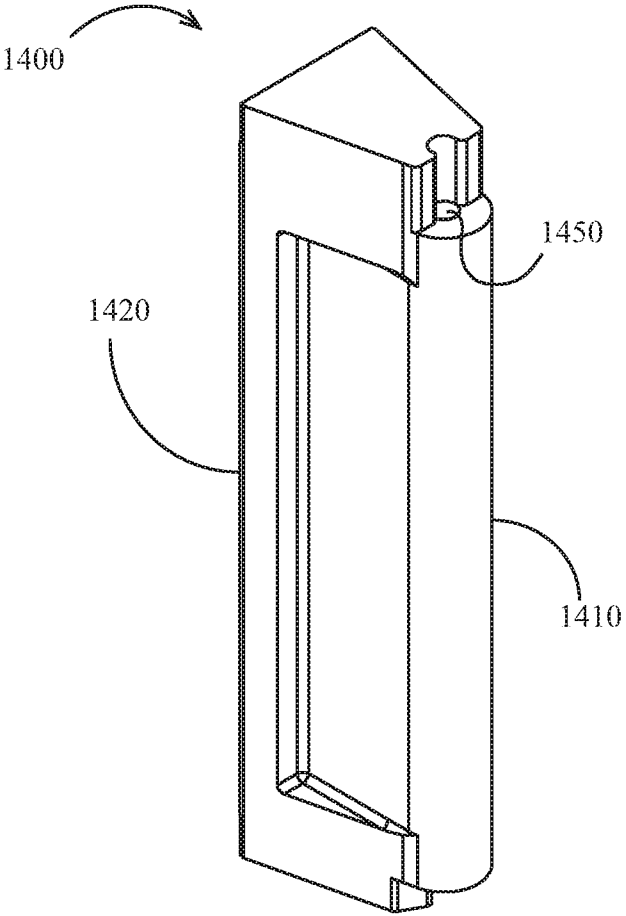
FIG. 14 is a perspective view of an embodiment of a wear tip holder.

Referring to FIGS. 14 and 15, an alternative rear wear tip holder 1400 is illustrated. The wear tip holder 1400 optionally comprises a body 1420 (e.g., made of cast metal such as steel). The body 1420 optionally extends generally vertically when installed on the rotor. The body 1420 optionally has upper and/or lower ends for inserting into corresponding openings in the rotor. The body 1420 optionally includes a holder portion 1410 which has a wear tip 1450 enclosed at least partially therein. The wear tip 1450 is optionally made of a wear-resistant material (e.g., carbide, tungsten carbide, etc.). The wear tip 1450 may be at least partially enclosed in the body 1420 by a number of manufacturing methods (e.g., inserting the wear tip into an opening provided in the body, overmolding, etc.). In some embodiments, a cross-sectional portion (e.g., horizontal cross-sectional portion) of the wear tip 1450 is optionally completely surrounded by the wear tip holder 1400; thus in such embodiments aggregate material does not contact the surrounded cross-sectional portion of the wear tip 1450 until at least some wear tip holder material surrounding the cross-sectional portion has been worn away (e.g., by contact with aggregate material). The wear tip 1450 is illustrated being generally circular in cross-section but may be of any constant or varying cross-sectional shape (e.g., oval, rectangular, polygonal, etc.). In some embodiments, the wear tip 1450 is optionally not completely surrounded but is shielded from contact with aggregate material (e.g., substantially surrounded) by the wear tip holder body 1420 until at least some material is worn away from the wear tip holder body.

It should be appreciated that the first wall portion 232 and the second wall portion 236 may comprise portions of a rotor sidewall (e.g., one of the sidewalls 243, 245, 247). In alternative embodiments, the first and second wall portions may comprise separate (e.g., separately removable) sidewalls; in some embodiments, the first and second wall portions may be welded together. In some embodiments, the sidewalls are generally planar instead of having differently-oriented wall portions.

Figure 8:
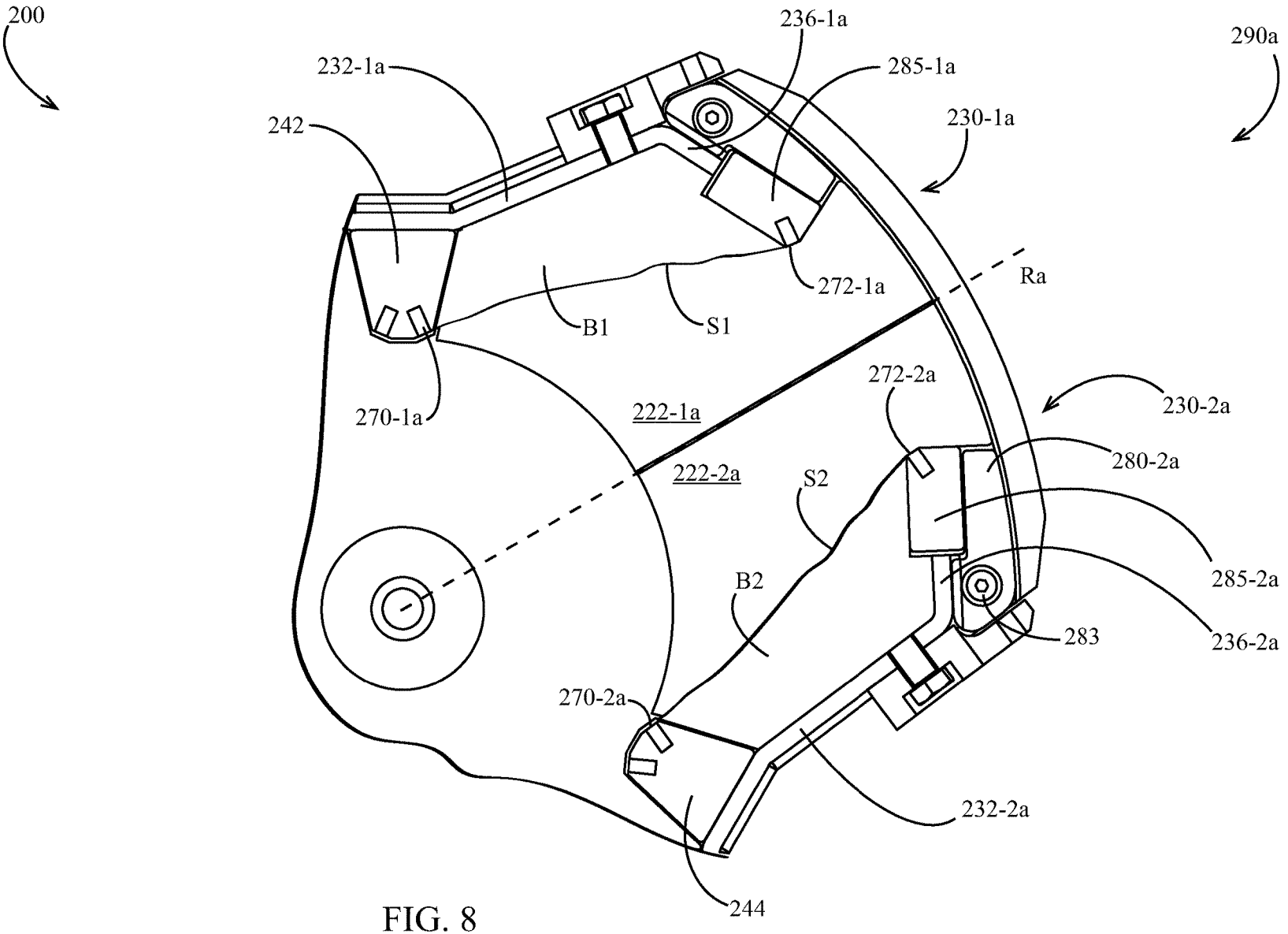
FIG. 8 a partial sectional side elevation view of the rotor of FIG. 4 along the section 6-6 of FIG. 5 illustrating beds of material in the rotor.

Referring to FIG. 8, during operation each wall arrangement 230 optionally retains a bed B of aggregate material. The illustrated bed B is generally illustrative of a volume of space generally occupied by retained aggregate material but it should be appreciated that the amount and shape of such volume may vary with one or more operational factors including the operational state of the rotor 200 and the type and size distribution of aggregate material. The bed B optionally has a general inward surface S which other aggregate may contact while being propelled from the rotor 200. A crusher rotor having one or more retained beds of material may be referred to as an autogenous rotor. The surface S optionally generally faces the plane R. The surface S is optionally closer to the radial plane R at an outward end thereof than at an inward end thereof. A lateral spacing between surfaces S1, S2 of opposing beds B1, B2 (e.g., beds of aggregate material) retained by wall arrangements 230-1, 230-2, respectively, is optionally narrower at a first, inner radial position than at a second, outer radial position. The surfaces S1, S2 are optionally generally symmetrical about the radial plane R. It should be appreciated that the surfaces S1, S2 comprise layers of material such as aggregate material and are not necessarily vertical, planar, or smooth.

Upper and lower lips 214, 254 are optionally positioned respectively above and below the opening 290. The upper and lower lips 214, 254 are optionally removably fastened (e.g., by bolts) to the upper and lower plates 262, 264, respectively. First and second side plates 287-1, 287-2 are optionally positioned laterally at opposing sides of the opening 290. The side plates 287 are optionally removably fastened (e.g., by a threaded fastener or fastener assembly such as bolts 233 and associated nuts) to respective sidewalls of the rotor 200.

Figure 9:
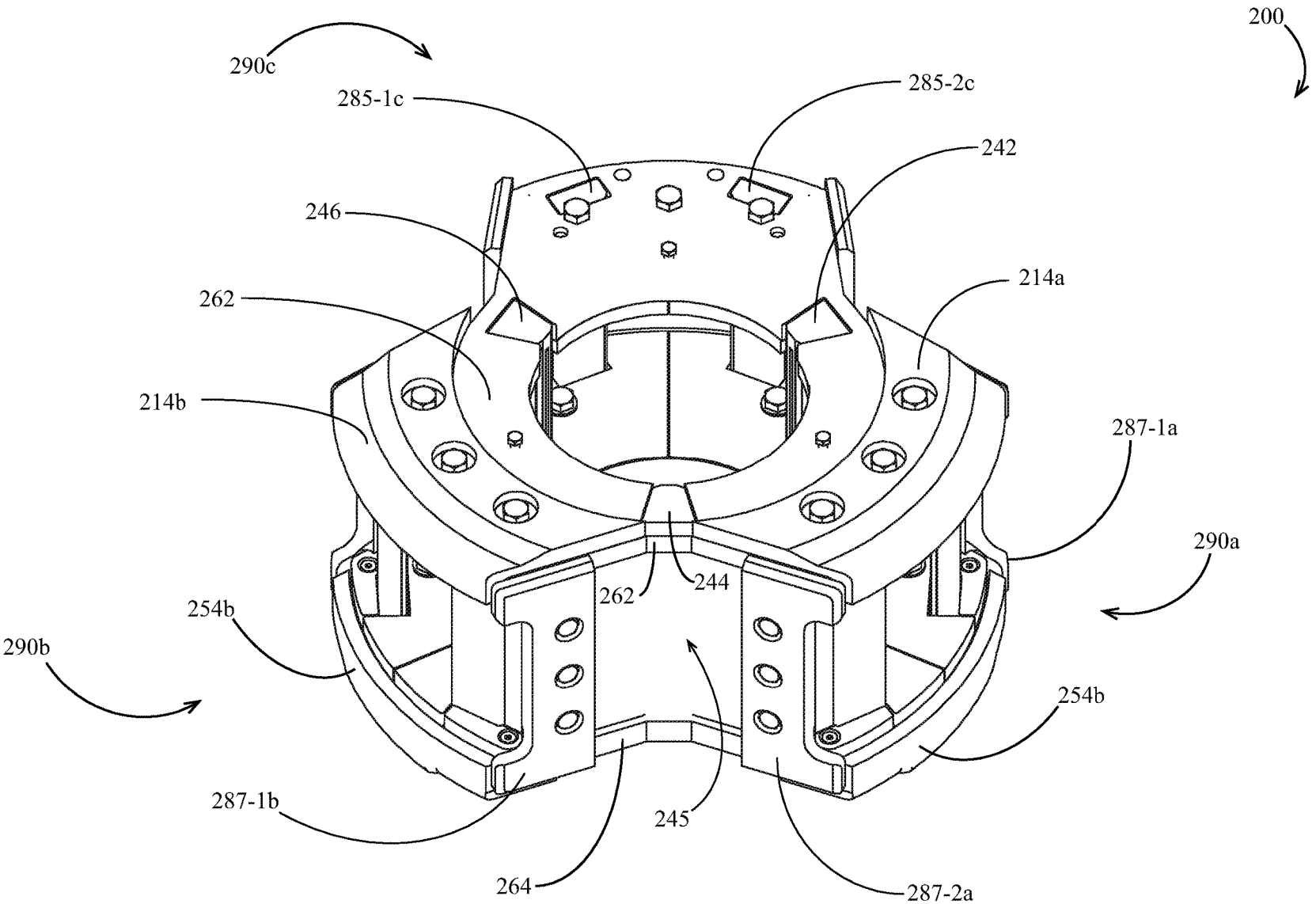
FIG. 9 is another isometric view of the rotor of FIG. 4 with certain components removed.

Referring to FIG. 9, in which the inlet ring 212 and the upper lip 214*c* are not shown, the wear tip holders 242, 244 and 246 are optionally partially received at upper ends thereof in the upper plate 262 in order to retain the position of the wear tip holders. Lower ends of the wear tip holders 242, 244, 246 may likewise be received in the lower plate 264. The wear tip holders 242, 244, 246 are optionally removable (e.g., when the inlet ring 212 is removed) by sliding vertically through notches or openings provided in the upper and/or lower plates. The wear tip holders 285 are optionally partially received at upper ends thereof in corresponding openings in the upper plate 262 in order to retain the position of the wear tip holders. The wear tip holders 285 are optionally partially received at lower ends thereof in corresponding openings in the lower plate 264 in order to retain the position of the wear tip holders. The wear tip holders 285 are optionally removable (e.g., when the corresponding lip is removed) by sliding vertically through the openings in the upper and/or lower plates. Referring to FIG. 7, the wear tip holders 285 may additionally be secured in position by retainers 280 disposed adjacent to (e.g., radially outwardly from) a lower end thereof. The retainers 280 may be removably mounted (e.g., by fasteners such as bolts 283) to the lower plate 264 and/or the lower lip 254. Similar retainers 280 may be provided adjacent to an upper end of the wear tip holders 285.

Comparing FIGS. 7 and 8, retained beds B of aggregate material optionally cover bolts 223 or other structure used to fasten the wear plates 222 in position. Moreover, retained beds B optionally cover bolt 233 and/or other structure (e.g., nuts) used to secure the side plates 287 in position. Thus the configuration of wall arrangement 230 relative to the bolts 223, 233 optionally creates a retained bed B of material that protects the bolts 223, 233 from contact with material being propelled from the rotor 200.

It should be appreciated that embodiments of rotor 200 having generally symmetrical wall arrangements 230-1, 230-2 (and/or generally symmetrical retained beds B1, B2) tend to propel and/or crush aggregate material in a similar manner regardless of which direction D1 or D2 (e.g., clockwise or counterclockwise on the view of FIG. 6) in which the rotor is rotated. Thus the rotor may be operated in a reversible manner; e.g., the rotor may be rotated in a first direction for a first period (e.g., a first wear part life cycle or fraction thereof) and then rotated in a second direction for a second period (e.g., a second wear part life cycle or fraction thereof). It should be appreciated that certain wear parts (e.g., removable parts) on one side of the opening 290 may be worn more quickly by rotation in a given direction (e.g., clockwise on the view of FIG. 6) as some material exiting loses angular velocity and is contacted by approaching wear parts disposed to one side of the radial axis R (e.g., wear plate 222-1, wear tip holder 238-1, wear tip 272-1, retainer 280-1, removable side plate 287-1). Thus the reversible nature of such rotor embodiments optionally enables an operator to occasionally reverse the direction of rotation of the rotor, which may increase the length of an overall wear life cycle of the rotor.

Figure 10:
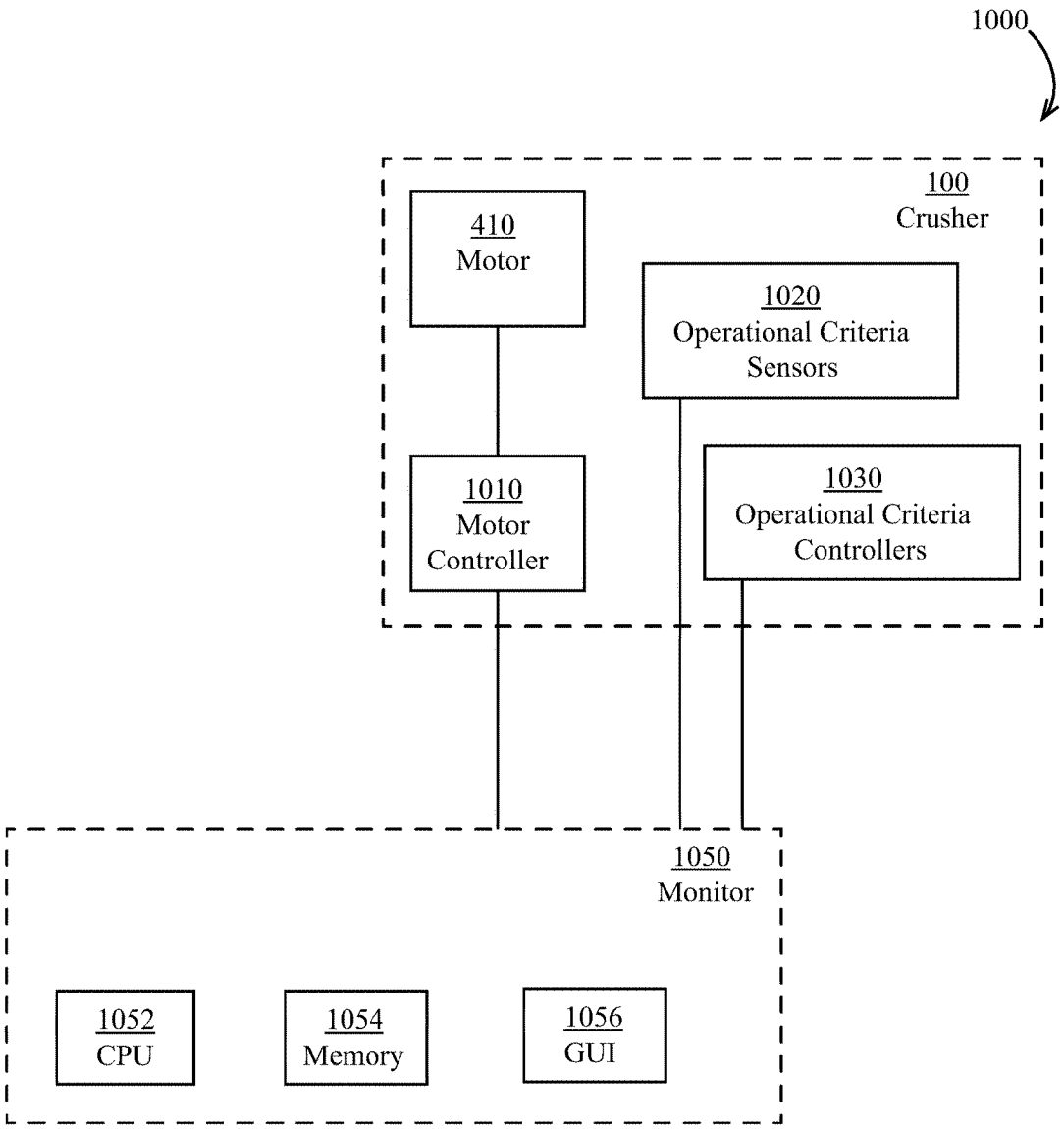
FIG. 10 schematically illustrates a control and monitoring system for a vertical shaft impact crusher.

Referring to FIG. 10, an embodiment of a control system 1000 illustrated. A monitor 1050 (e.g., an electronic monitor having a central processing unit 1052, memory 1054, and graphical user interface ("GUI") 1056) may optionally be used in some embodiments to monitor and/or control the speed and/or direction of rotation of the rotor 200. In other embodiments, the motor is controlled with another controller (e.g., electrical switch) which may optionally be provided on the motor. The monitor 1050 may be in data communication with the motor 410 and/or with an intervening motor controller 1010 for transmitting motor speed and/or direction commands to the motor. The motor speed and/or direction commands may be used to selectively reverse a drive direction of the motor 410 and thus optionally selectively reverse a rotational direction D (e.g., clockwise or counterclockwise on the view of FIG. 6) of the rotor 200. The motor speed and/or direction commands may be based on a user input entered using the GUI 1056 and/or may be based on timed commands stored in memory (e.g., a schedule stored in memory that may call for a change from a first rotor direction to a second rotor direction after a threshold number of crusher startups and/or a threshold number of hours of crusher operation in a first rotor direction). The monitor 1050 may additionally be in data communication with one or more operational criteria sensors 1020 (e.g., motor speed sensors, temperature sensors, kinematic sensors such as accelerometers, cover actuator position sensors) on the crusher 100 in order to monitor and/or display the associated operational criteria on the GUI 1056. The motor controller may additionally be in data communication with one or more additional operational criteria controllers 1030 (e.g., actuator position controllers), in order to send command signals to the controllers 1030 (e.g., based on a user input entered using the GUI 1056).

Crushing Chamber Embodiments

Figure 11:
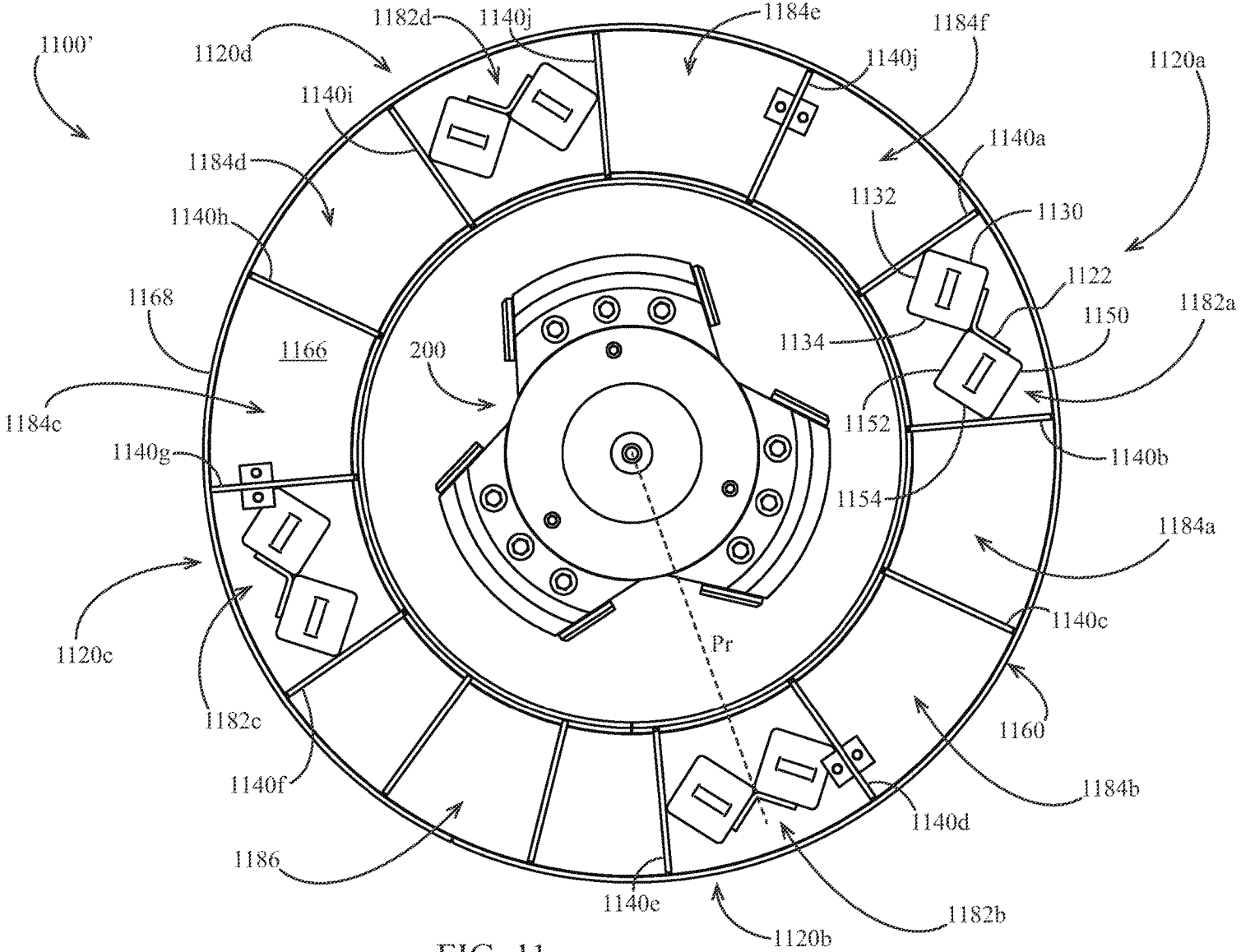
FIG. 11 is a plan view of the rotor of FIG. 4 and an embodiment of a crushing chamber.
Figure 12:
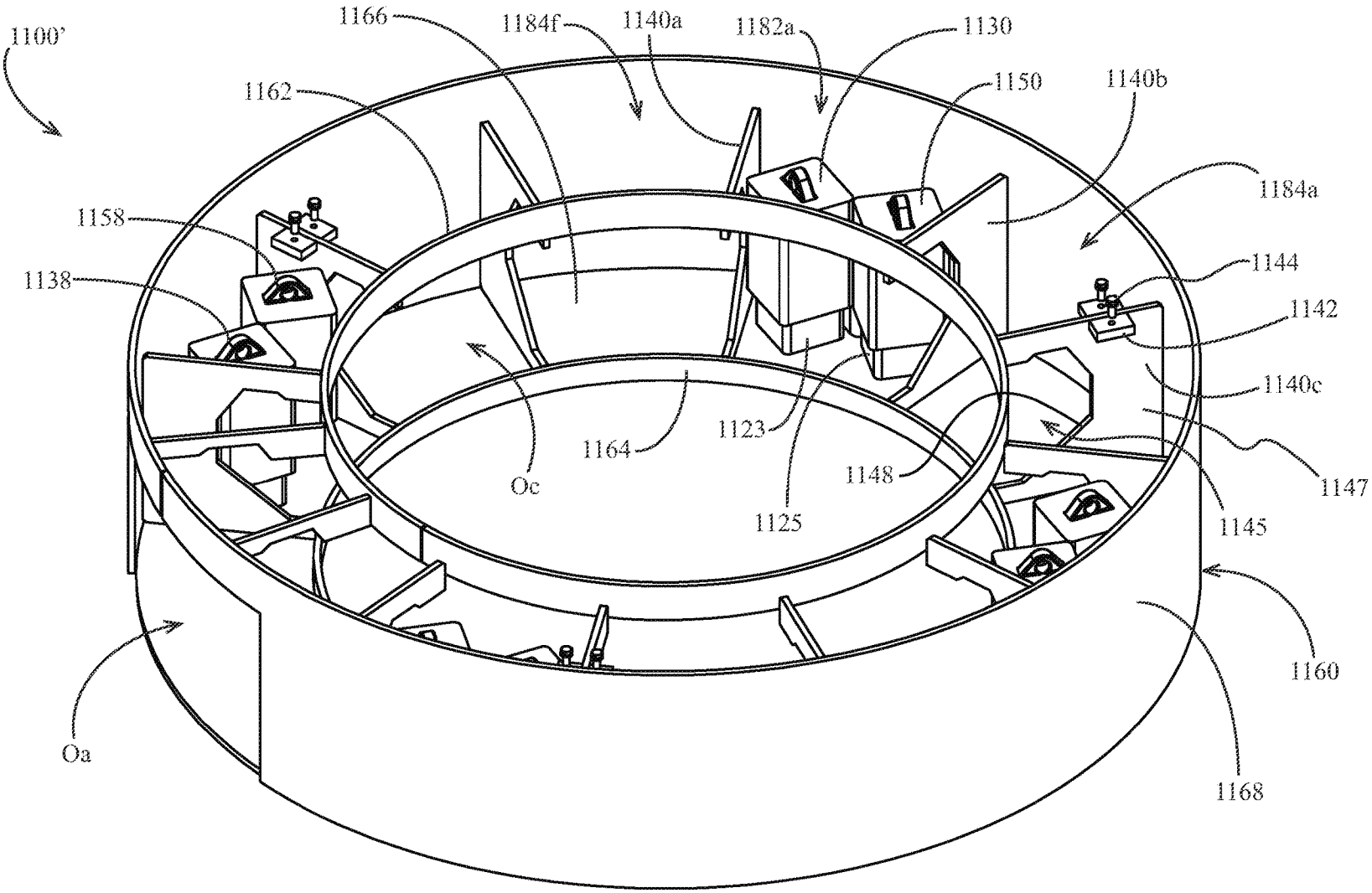
FIG. 12 is an isometric view of the crushing chamber of FIG. 11.
Figure 13:
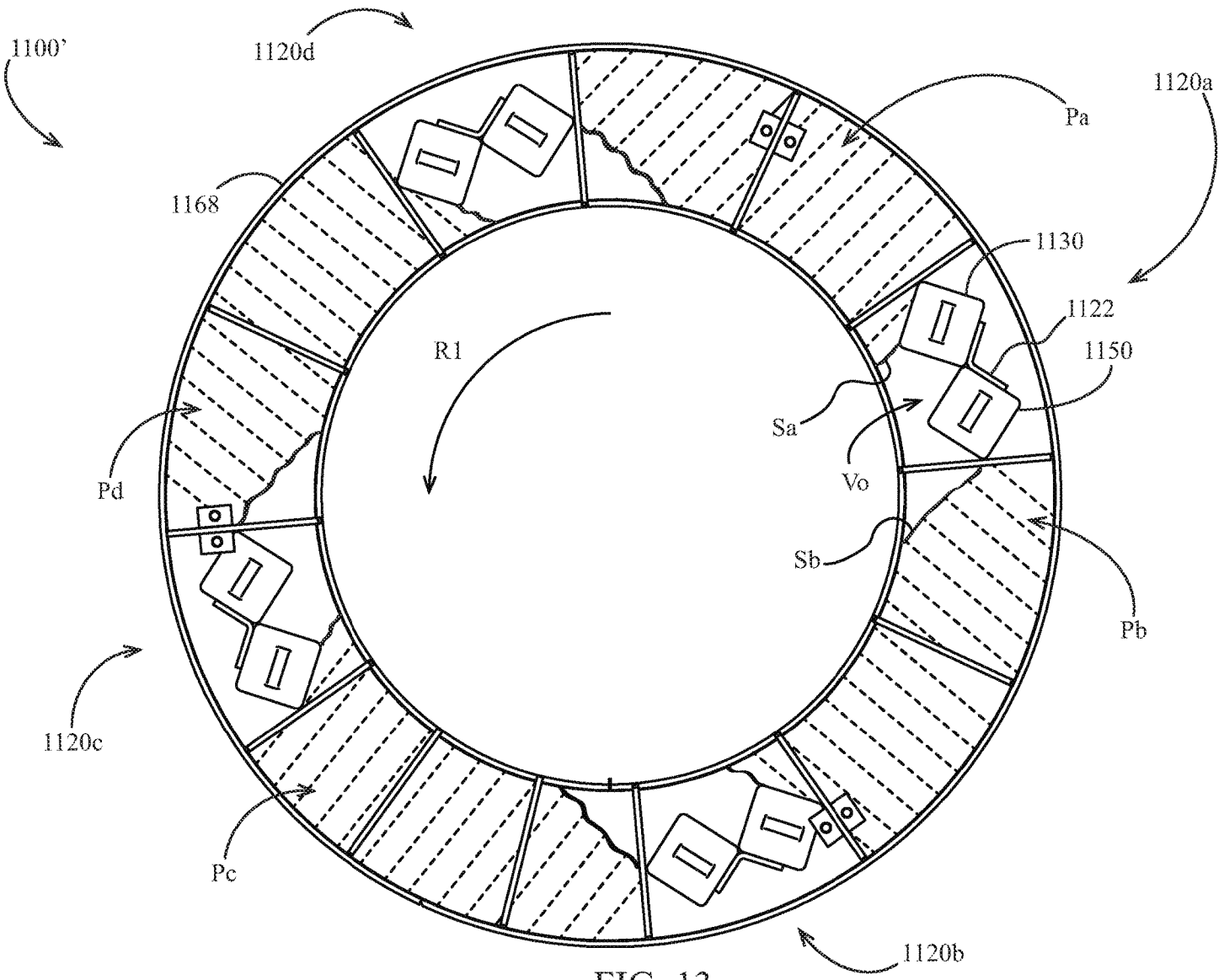
FIG. 13 is a plan view of the crushing chamber of FIG. 11 with an exemplary rockpack configuration schematically illustrated.

Referring to FIGS. 11-13, a crushing chamber 1100' is illustrated. The crushing chamber 1100' optionally comprises a housing 1160 having a floor 1166 and a circumferential wall 1168. A lower lip 1164 optionally extends upward from the floor 1166. A circumferential opening Oc (e.g., above the lower lip 1164) is optionally disposed to permit rock thrown from the rotor 200 to enter the crushing chamber 1100'. An upper lip 1162 is optionally disposed above the circumferential opening Oc. An optional circumferential opening Oa in the circumferential wall 1168 is optionally aligned with a selectively displaceable access door (not shown) disposed radially outwardly of the crushing chamber.

A plurality of support members 1140 (e.g., plates) optionally extend radially within the crushing chamber 1100'. In the illustrated embodiment, the crushing chamber 1100' includes support members 1140*a* through 1140*j*. Each support member 1140 is optionally mounted (e.g., by welding) to the floor 1166, the circumferential wall 1168, the lower lip 1164, and/or the upper lip 1162. Each support member 1140 optionally includes an opening 1145. The opening 1145 optionally includes a lower surface 1148 which optionally rises from the floor 1166 with increasing radial distance from the rotor 200. Each support member 1140 optionally includes a wall portion 1147. The wall portion 1147 is optionally mounted (e.g., by welding) to the circumferential wall 1168. The wall portion 1147 is optionally disposed radially outwardly of the opening 1145. The support member 1140 optionally includes upper and lower arms which are optionally mounted (e.g., by welding) to the upper and lower lips 1162, 1164, respectively. In some embodiments each support member 1140 generally comprises a metal plate.

The crushing chamber 1100' optionally includes one or more tabs 1142 for removably mounting a lid (not shown). The lid is optionally annular and optionally extends inwardly from the circumferential wall 1168. The tabs 1142 may be mounted to the support members 1140 as illustrated or to other structure such as the upper lip 1162 or the circumferential wall 1168. The tabs 1142 optionally include openings for attaching a fastener 1144 (e.g., a bolt) to removably secure the lid to the crushing chamber.

The crushing chamber 1100' optionally includes one or more anvil assemblies 1120. In the illustrated embodiment, the anvil assemblies 1120*a* through 1120*d* are optionally arranged concentrically about the rotational axis A of the rotor 200. The anvil assemblies 1120 are optionally arranged radially symmetrically about the axis A (e.g., at 90 degree intervals as illustrated).

Each anvil assembly 1120 optionally includes a plurality of anvils. In the illustrated embodiment, each anvil assembly 1120 optionally includes a first anvil 1130 and a second anvil 1150. In alternative embodiments, the anvil assemblies include a single anvil. The anvils optionally comprise a cast component (e.g., cast steel). The anvils may be made of a different material (e.g., cast steel, an abrasive resistant steel, abrasive resistant cast steel, 28% chrome abrasive resistant cast steel, etc.) than the remainder of the crushing chamber. The remainder of the crushing chamber (e.g., the circumferential wall, floor, support members, upper lip and/or lower lip) may be formed from a metal such as steel (e.g., mild steel, A36 mild steel).

Each anvil 1130 optionally includes a first surface 1132 and a second surface 1134. Each anvil 1150 optionally includes a first surface 1152 and a second surface 1154.

In some embodiments, the crushing chamber 1100' is configured to crush aggregate material against a first plurality of anvil surfaces when the rotor 200 rotates in a first direction and to crush aggregate material against a second plurality of anvil surfaces when the rotor 200 rotates in a second direction. Referring to FIGS. 11 and 13, when the rotor 200 rotates in a direction R1, aggregate material thrown from the rotor is optionally crushed against (e.g., primarily crushed against or exclusively crushed against) the surfaces 1134 and 1154. When the rotor 200 rotates in the direction opposite the direction R1, aggregate material thrown from the rotor is optionally crushed against (e.g., primarily crushed against or exclusively crushed against) the surfaces 1132 and 1152. The surfaces 1134, 1154 optionally generally face the rotational direction R1. The surfaces 1132, 1152 optionally generally face the direction opposite the rotational direction R1.

The anvils 1130, 1150 of each anvil assembly are optionally disposed symmetrically about a radial plane Pr extending from the axis A between the anvils 1130, 1150. The surfaces 1134, 1152 are optionally disposed symmetrically about a radial plane Pr extending from the axis A between the anvils 1130, 1150. The surfaces 1132, 1154 are optionally disposed symmetrically about the radial plane Pr. The surfaces 1152, 1154 are optionally disposed symmetrically about a radial plane extending through the anvil 1150. The surfaces 1132, 1134 are optionally disposed symmetrically about a radial plane extending through the anvil 1130.

The anvils 1130, 1150 are optionally removably installed in the crushing chamber 1100'. The anvils 1130, 1150 are optionally supported on (e.g., rest on) supports 1123, 1125 respectively. A boss (not shown) is optionally provided at a lower end of each anvil 1130, 1150 to engage with the supports 1123, 1125 respectively in order to prevent horizontal movement of the anvil. In other embodiments, the anvils may be secured (e.g., removably secured) in position relative to floor 1166 (e.g., by one or more bolts or other fasteners). The supports 1123, 1125 optionally comprise square tubes. The supports 1123, 1125 are optionally mounted (e.g., by welding) to the floor 1166. Lift points 1138, 1158 are optionally provided on the anvils 1130, 1150, respectively (e.g., at upper ends thereof) in order to facilitate placing and removing the anvils.

A backing support 1122 is optionally disposed radially outwardly from the anvils 1130, 1150. In operation, the backing support 1122 optionally contacts and optionally supports the anvils 1130, 1150. The support members adjacent to each anvil assembly 1120 optionally contact and optionally support the anvils 1130, 1150.

The support members 1140 adjacent to each anvil assembly 1120 (e.g., support members 1140*a*, 1140*b*) optionally generally define a plurality of anvil chambers 1182 (e.g., anvil chambers 1182*a* through 1182*d*). A plurality of rock shelf chambers 1184 (e.g., rock shelf chambers 1184*a* through 1184*f*) are optionally positioned between pairs of support members 1140. The rock shelf chambers 1184 are generally circumferentially positioned between anvil assemblies 1120. The rock shelf chambers 1184 optionally include an empty space positioned between circumferentially spaced support members 1140. The rock shelf chambers 1184 optionally do not include an anvil therein.

Referring to FIG. 13, during operation, rock packs P (indicated schematically by dashed lines) optionally form on floor 1166 from aggregate material thrown by rotor 200. Each rock pack P (e.g., rock packs Pa through Pd) optionally at least partially (e.g., substantially) fills each rock shelf chamber 1184. The lower lip 1164, upper lip 1162 and/or support members 1140 of each rock shelf chamber 1184 optionally cooperate to retain a rock pack P in the rock shelf chamber. An open volume Vo is optionally positioned generally radially inwardly of each anvil assembly 1120. Each open volume Vo is optionally positioned generally between rock pack surfaces Sa and Sb. Each open volume Vo optionally permits aggregate material to be thrown against crushing surfaces of the anvil assembly 1120, e.g., a subset of the inwardly-facing crushing surfaces not covered (or less covered) by adjacent rock packs. In operation, aggregate material thrown from rotor 200 optionally contacts (e.g., is crushed against) rock that has filled the rock shelf chamber 1184.

In some implementations, only a subset of the anvils 1130, 1150 are selectively installed in the crushing chamber 1100'. When one or more anvils are not installed in a given anvil chamber, the portion of the anvil chamber optionally fills with additional aggregate material. It should be appreciated that selectively installing more or fewer anvils in the crushing chamber may modify one or more overall statistical criteria (e.g., size, shape, cubicity, dimensions, etc.) of the material produced by the vertical shaft impact crusher (e.g., an average of such criteria, a statistical deviation of such criteria, a minimum value of such criteria, a maximum value of such criteria, etc.). In some embodiments, anvil support structure (e.g., one or more supports 1123, 1125 and/or backing support 1122) is provided between each pair of radially extending support members 1140 such that any one or more of the circumferential spaces between the support members 1140 may be selectively configured as a rock shelf chamber (e.g., by removing or not installing any anvils between the support members 1140) or as an anvil chamber (e.g., by installing or not removing one or more anvils between the support members 1140).

In some crusher embodiments, alternative rotor embodiments (e.g., having a different number or arrangement of ports) other than the rotor 200 and/or other distribution mechanisms (e.g., open shoe tables) are used in conjunction with the crushing chamber embodiments described herein.

In some crusher embodiments, alternatives to the crushing chambers illustrated herein may be employed; for example, an impact ring such as an anvil ring or a fully autogenous (e.g., fully rock-on-rock) crushing chamber may surround any of the rotor embodiments described herein. Various crushing chambers in various alternative embodiments do not include enclosed or partially enclosed spaces (e.g., rock shelves).

The various vertical shaft impact crusher embodiments described herein may be supported in a fixed manner on the ground or may be portable (e.g., supported on skids, wheels, tracks, etc.) The various vertical shaft impact crusher embodiments described herein may be employed in a self-standing manner or incorporated on a plant (e.g., a portable or fixed plant) which may include other equipment (e.g., conveyors, washing and/or dewatering screens, hydraulic classifiers, hydrocyclones, classifying tanks, sand screws, etc.).

The various crusher components described herein may be employed on other crusher types than vertical shaft impact crushers, or on vertical shaft impact crushers which are oriented other than vertically.

Unless otherwise indicated expressly or by the context or function of various components, the components described herein may be made of metal such as steel.

Ranges recited herein are intended to inclusively recite all values within the range provided in addition to the maximum and minimum range values. Headings used herein are simply for convenience of the reader and are not intended to be understood as limiting or used for any other purpose.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. A rotor positioned to rotate about a central axis and at least partially radially inwardly of a crushing chamber, said rotor comprising:

an upward-facing inlet opening axial with said central axis;

at least one outward-facing outlet opening for receiving aggregate material, said outlet opening along a first radial plane intersecting said central axis;

a first wall arrangement disposed to a first lateral side of said first radial plane, said first wall arrangement configured to retain a first bed of aggregate material upon rotation of said rotor;

a second wall arrangement disposed to a second lateral side of said first radial plane, said second wall arrangement configured to retain a second bed of aggregate material upon rotation of said rotor, said first wall arrangement and said second wall arrangement being symmetrical about said first radial plane, wherein said outward-facing outlet opening is defined on a first side thereof by a first inward-facing planar surface, said first inward-facing planar surface comprising a distal end of said first wall arrangement, and wherein said outward-facing outlet opening is defined on a second side thereof by a second inward-facing planar surface, said second inward-facing planar surface comprising a distal end of said second wall arrangement.

2. The rotor of claim 1, wherein upon rotation of the rotor, a first subset of said aggregate material contacts said first bed before exiting said outlet opening, and wherein a second subset of said aggregate material contacts said second bed before exiting said outlet opening.

3. The rotor crusher of claim 1, wherein said first bed has a first inner surface, and wherein said second bed has a second inner surface, and wherein said first and second inner surfaces are symmetrical about said first radial plane.

4. The rotor of claim 1, wherein said first and second beds are symmetrical about said first radial plane.

5. The rotor of claim 1, further comprising:

a floor disposed radially inwardly of the outlet opening, the floor including at least one removable wear plate, the floor being disposed symmetrically about said first radial plane.

6. The rotor of claim 5, further comprising a fastener for removably securing at least one removable wear plate in position, wherein said fastener is covered by one of said first and second beds during operation.

7. The rotor of claim 1, wherein said central axis is vertical.

8. The rotor crusher of claim 1, wherein each of said first and second wall arrangements comprise a sidewall, a rear wear tip holder securing a rear wear tip, and a forward wear tip holder securing a forward wear tip.

9. The rotor of claim 8, wherein a horizontal cross-sectional portion of said rear wear tip is at least partially surrounded by said rear wear tip holder such that aggregate material does not contact said horizontal cross-sectional portion until at least some material of said rear wear tip holder is removed.

10. The rotor of claim 1, wherein said first wall arrangement comprises a sidewall having first and second wall portions, said first wall portion being disposed at a first offset angle relative to said first radial plane, said second wall portion being disposed at a second offset angle relative to said first radial plane, said second offset angle being greater than said first offset angle.

11. The rotor of claim 1, wherein said rotor is positioned with respect to at least one anvil of the crushing chamber, wherein said anvil includes a first vertical face and a second vertical face, wherein said first and second vertical faces are disposed symmetrically about a second radial plane extending through said anvil, wherein rotation of said rotor causes aggregate material to be thrown outward from said rotor through said at least on outlet opening toward said at least one anvil.

12. The rotor of claim 1, wherein said rotor is positioned with respect to first and second anvils of the crushing chamber, wherein said first and second anvils are disposed symmetrically about a second radial plane extending between said first and second anvils such that rotation of said rotor causes aggregate material to be thrown outward from said rotor through said at least on outlet opening toward said first and second anvils.

13. The rotor of claim 12, wherein first and second anvils are removably supported on a circumferential floor of the crushing chamber.

14. The rotor of claim 1, wherein said rotor is configured to be operably coupled with a motor for rotating said rotor about the central axis.

15. The rotor of claim 1, further comprising:

a first wear-resistant wear tip removably mounted at said distal end of said first wall arrangement; and a second wear-resistant wear tip removably mounted at said distal end of said second wall arrangement.

16. The rotor of claim 15, wherein both of said first and second wear-resistant wear tips are at least partially comprised of tungsten carbide.

17. A vertical shaft impact crusher, comprising:

a crushing chamber being arranged circumferentially about a central axis, said crushing chamber comprising:

a circumferential floor;

an outer circumferential wall;

a lower circumferential lip;

a plurality of rock shelf chambers, each rock shelf chamber configured to support a bed of aggregate material, each rock shelf chamber comprising:

a first support extending radially at least partway from said lower circumferential lip to said outer circumferential wall;

a second support extending radially at least partway from said lower circumferential lip to said outer circumferential wall, said first and second supports being circumferentially spaced apart such that an empty space is defined between the first and second supports;

a plurality of anvils removably supported on said circumferential floor, said plurality of anvils supported outside of said plurality of rock shelf chambers; and a rotor disposed to rotate about said central axis, said rotor disposed at least partially radially inwardly of said crushing chamber, said rotor comprising:

an upward-facing inlet opening, said axis extending through said inlet opening;

at least one radially outward-facing outlet opening, said outlet opening intersecting a first radial plane, said first radial plane intersecting said axis;

a first wall arrangement disposed to a first lateral side of said first radial plane;

a second wall arrangement disposed to a second lateral side of said first radial plane, said second wall arrangement and said second wall arrangement being symmetrical about said first radial plane, wherein rotation of said rotor causes aggregate material to be thrown outward from said rotor through said at least one outlet opening toward said crushing chamber such that a first subset of aggregate material fills each of said rock shelf chambers to form a plurality of beds of aggregate material in said rock shelf chambers, a second subset of aggregate material contacts at least one of said plurality of beds of aggregate material, and a third subset of aggregate material contacts at least one of said plurality of anvils.

18. The vertical shaft impact crusher of claim 17, further comprising:

a floor disposed radially inwardly of the outlet opening, the floor including at least one removable wear plate, the floor being disposed symmetrically about said first radial plane.

19. The vertical shaft impact crusher of claim 18, further comprising a fastener for removably securing at least one removable wear plate in position, wherein said fastener is covered by a bed of aggregate material during operation.

20. The vertical shaft impact crusher of claim 17, wherein said central axis is vertical.

21. The vertical shaft impact crusher of claim 17, wherein each of said first and second wall arrangements comprise a sidewall, a rear wear tip holder securing a rear wear tip, and a forward wear tip holder securing a forward wear tip.

22. The vertical shaft impact crusher of claim 17, wherein each of said plurality of anvils is oriented symmetrically about said radial plane.

23. The vertical shaft impact crusher of claim 22, wherein a first anvil and a second anvil of said plurality of anvils are disposed symmetrically to one another about said radial plane.

24. The vertical shaft impact crusher of claim 17, wherein a first anvil and a second anvil of said plurality of anvils are disposed symmetrically to one another about said radial plane.

25. A method of crushing aggregate material, comprising:

rotating a rotor in a first direction about a vertical axis;

receiving aggregate material in said rotor;

retaining a first bed of aggregate material in said rotor against a first inward-facing planar surface;

retaining a second bed of aggregate material in said rotor against a second inward-facing planar surface;

by rotation of said rotor, dispersing aggregate material radially between said first and second beds from said rotor such that aggregate material contacts at least one of said first and second beds;

striking aggregate material dispersed from said rotor against a crushing chamber disposed radially outwardly of said rotor; and rotating said rotor in a second direction opposite said first direction about said vertical axis, and releasing aggregate material from an outward-facing outlet opening, wherein said outward-facing outlet opening is defined on a first side thereof by said first inward-facing planar surface, and wherein said outward-facing outlet opening is defined on a second side thereof by said second inward-facing planar surface.

26. The method of claim 25, wherein said first and second beds are symmetrical.

27. The method of claim 25, further comprising:

selectively installing one or more anvils on a subset of anvil supports in said crushing chamber; and accumulating a rock pack in an open volume in said crushing chamber.

28. The method of claim 27, further comprising:

orienting said one or more anvils symmetrically about a vertical radial plane extending through said vertical axis.

29. The method of claim 25, further comprising:

removably supporting a floor disposed symmetrically about a vertical plane extending through said vertical axis; and supporting said first and second beds on said floor.

30. The method of claim 25, further comprising:

installing a first removable wear tip holder adjacent to a sidewall to form a first wall arrangement;

installing a second removable wear tip holder adjacent to a sidewall to form a second wall arrangement;

supporting said first bed against said first wall arrangement; and supporting said second bed against said second wall arrangement.

* * * * *